US009932972B2

(12) United States Patent
Balenghien et al.

(10) Patent No.: US 9,932,972 B2
(45) Date of Patent: Apr. 3, 2018

(54) HYDRAULIC MACHINE COMPRISING CYLINDERS PROVIDED WITH ANGULARLY OFFSET OPENINGS

(71) Applicant: TECHNOBOOST, Paris (FR)

(72) Inventors: Olivier Balenghien, Le Raincy (FR); Ante Bozic, Compiegne (FR)

(73) Assignee: Technoboost, Paris (FR)

( * ) Notice: Subject to any disclaimer, the term of this patent is extended or adjusted under 35 U.S.C. 154(b) by 229 days.

(21) Appl. No.: 14/897,614

(22) PCT Filed: May 28, 2014

(86) PCT No.: PCT/FR2014/051261

§ 371 (c)(1),
(2) Date: Dec. 10, 2015

(87) PCT Pub. No.: WO2014/199041

PCT Pub. Date: Dec. 18, 2014

(65) Prior Publication Data

US 2016/0131117 A1 May 12, 2016

(30) Foreign Application Priority Data

Jun. 12, 2013 (FR) ..... 13 55462

(51) Int. Cl.

| | |
|---|---|
| ***F04B 1/20*** | (2006.01) |
| ***F03C 1/34*** | (2006.01) |
| ***F01B 3/00*** | (2006.01) |
| ***F03C 1/06*** | (2006.01) |

(52) U.S. Cl.

CPC ..... *F04B 1/20* (2013.01); *F01B 3/007* (2013.01); *F03C 1/0636* (2013.01); *F03C 1/0655* (2013.01); *F04B 1/2042* (2013.01)

(58) Field of Classification Search

CPC .... F03C 1/0636; F03C 1/0655; F01B 3/0032; F01B 3/007; F04B 1/20; F04B 1/2042

See application file for complete search history.

(56) References Cited

U.S. PATENT DOCUMENTS

| | | | | |
|---|---|---|---|---|
| 5,281,104 A | 1/1994 | Bublitz | | |
| 5,358,388 A | 10/1994 | Schutten et al. | | |
| 6,971,232 B2 * | 12/2005 | Singh | ..... | B60K 6/12 251/30.02 |

FOREIGN PATENT DOCUMENTS

| | | |
|---|---|---|
| CH | 490610 A | 5/1970 |
| DE | 4127751 C1 | 11/1992 |
| JP | H07310646 A | 11/1995 |

OTHER PUBLICATIONS

Inernational Search Report from corresponding International Application No. PCT/FR2014/051261 dated Aug. 8, 2014.

* cited by examiner

*Primary Examiner* — Logan Kraft
(74) *Attorney, Agent, or Firm* — Polster, Lieder, Woodruff & Lucchesi, LC

(57) ABSTRACT

A hydraulic machine comprising a drum (12) rotated by an input shaft, comprising cylinders (14) distributed around the shaft, each receiving a piston that slides on the basis of the rotation of the shaft, each cylinder opening at an opening (30) on a transverse face of the drum bearing on a plate having inlet and outlet manifolds, the openings (30) comprising, relative to the cylinders (14) of same, angular offsets comprised within a total offset range, characterized in that the offsets of the openings (30) are disposed at one end or the other of this offset range.

10 Claims, 2 Drawing Sheets

HYDRAULIC MACHINE COMPRISING CYLINDERS PROVIDED WITH ANGULARLY OFFSET OPENINGS

CROSS-REFERENCE TO RELATED APPLICATIONS

The present application is the US National Stage under 35 USC § 371 of PCT/FR2014/051261, which in turn claims priority to French Application Number 1355462 which was filed on Jun. 12, 2013.

BACKGROUND

The present invention relates to a hydraulic machine comprising several pistons sliding in cylinders, a method for calculating the openings of the manifolds of this machine, and a hybrid vehicle equipped with such a hydraulic machine.

A known type of hydraulic machine with a drum, presented in particular in U.S. Pat. No. 5,358,388, comprises a motor driven input shaft which rotationally drives a drum barrel having a succession of parallel cylinders regularly distributed around the axis of the shaft. Each cylinder receives a piston which rests axially on one side, called by convention the front side, on a tilting tray which is fixed in rotation, through the intermediary of a bearing forming an axial abutment.

One rotation of the drum moves each piston according to a complete cycle with a stroke which depends on the tilt angle of the tray, the angle being adjustable by a tilt command. In this way, the displacement can change from zero when the tilting tray is perpendicular to the shaft, to a maximum displacement when the tilt of the tray is at its maximum.

The rear face of the drum, opposite the tilting tray, rests against a fixed circular plate which closes the ends of the cylinders, in order to ensure sealing. The plate comprises a low pressure manifold and a high pressure manifold each forming a circular arc located facing a series of cylinders, the manifolds being separated by sufficient space so that each of the cylinders closes one of the manifolds before opening the other.

With these piston machines, each time a cylinder opens to one of the manifolds, a pressure shock is generated in the cylinder which reverberates via the piston to the tilting tray, producing vibrations of the machines resulting in noise emissions. The noise emissions have a main frequency corresponding with the number of cylinders multiplied by the rotational speed of the machine, and multiple harmonic frequencies of this main frequency, which generate a noise similar to that of a siren.

To limit the noise emissions, certain openings of the ends of the cylinders, resting against the plate, comprise relative to their cylinders, a small angular offset tangent to the direction of rotation, which is limited to a few degrees. In particular, certain openings are aligned on the cylinder, without offset, while others are, according to the direction of rotation of the drum, a little in advance or behind relative to their cylinders.

In this way, inside a total offset adjustment range centered on the axis of the cylinder, there are different degrees of offsets, comprising a null offset, small offsets on both sides, and large offset on both sides.

The above-mentioned prior art document provides, for this type of hydraulic machine, a reduction of certain frequencies of noise emissions, due to the relative irregularity of the successive periods between the openings and the closings of each cylinder relative to the collectors.

However, tests have shown that the reduction of noise emissions is not sufficient, in particular for applications in a hybrid vehicle comprising pumps and hydraulic machines rotating at relatively high speeds, in order to store hydraulic energy in one of the pressure accumulators and to return the pressure afterwards to save energy.

In addition, in these vehicles the noise signature emitted by this type of machine has the effect of a siren, which is very different from the noise emissions of the combustion engine. These noises are unpleasant, and can bother the driver and those with the driver, in particular when driving in hybrid mode which occurs alternatively and automatically, by switching from combustion engine traction to hydraulic motor traction.

SUMMARY

The goal of the present invention is to eliminate these disadvantages of the prior art.

For this purpose, the invention proposes a hydraulic machine comprising a drum driven in rotation by an input shaft and cylinders distributed around the axis, each receiving a piston sliding as a function of the rotational speed of the shaft, each cylinder protruding through an opening in the transverse face of the drum and resting against a circular plate having inlet and outlet manifolds, the openings comprising, relative to their cylinders, angular offsets within a total range of offsets, characterized in that the offsets of the openings are disposed on both ends of this offset range.

One advantage of this hydraulic machine is that for a selected offset range, when the offset changes sides, in a simple manner a maximum offset is obtained, equivalent to the total range, from one opening to another. Measurements and tests have shown that the largest possible offset of this type, disposed in irregular manner over a full cycle of the hydraulic machine gives the best results with respect to noise reduction and the noise signature which approaches the signature of a combustion engine.

Furthermore, the hydraulic machine can comprise one or more of the following characteristics which can be combined.

Advantageously, the total offset range of the openings is between 2 and 4°.

In particular, the offset range of each cylinder can be centered on the corresponding cylinder axis.

According to an embodiment, the machine comprises several pistons, for instance 7 or 9, comprising opening offsets from one side or the other both of the offset range, which follow the following sequence noted "0" on one side and "1" on the other side:

1; 0; 0; 1; 0; 1; 1; 1; 0.

The goal of the invention is also a calculation method of the offset sequence of the openings for a hydraulic machine comprising any one of the preceding characteristics, which uses a "Scrambler" type interference prediction method.

Advantageously, the calculation method applies an additive calculation method transforming the original data sequence in a sequence which applies a pseudo random binary order of the type "PRBS", by addition of the modules in pairs.

Another goal of the invention is a hybrid automotive vehicle having at least a hydraulic machine used for traction, comprising any one of the preceding characteristics.

DESCRIPTION OF THE DRAWINGS

The invention will be better understood and other characteristics and advantages will become more clear by reading the following description, given as a non-limiting example, with reference to the attached drawings in which.

DETAILED DESCRIPTION

Figure 1:
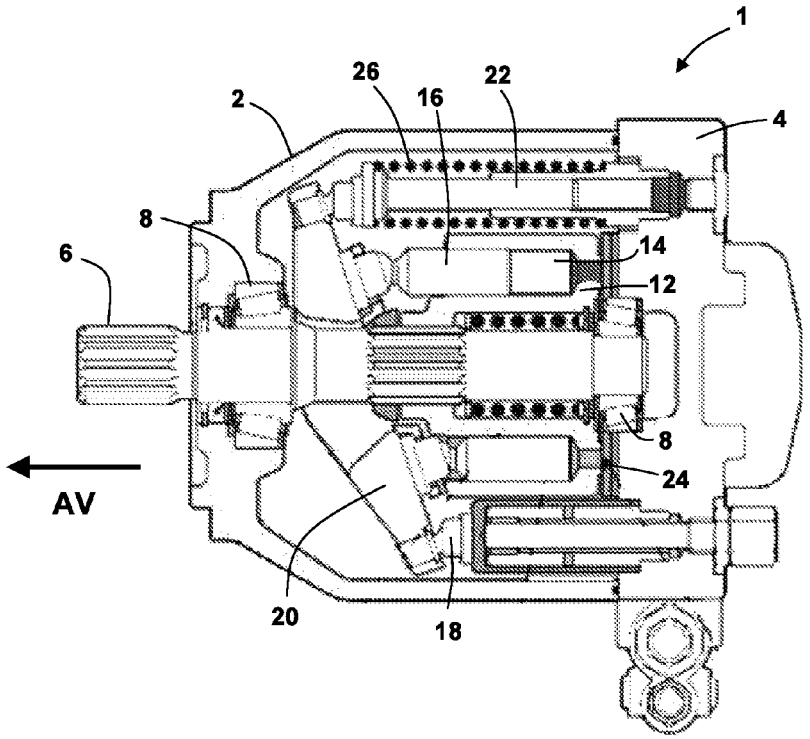
FIG. 1 is a view of an axial section of a hydraulic machine with axial pistons.

FIG. 1 represents a hydraulic machine 1 which can rotate in both directions, in general comprising a cylindrical body 2 closed at the rear end by a cover 4. The body 2 and the cover 4 both support a tapered roller bearing 8, which guides the input shaft 6 disposed along the axis of the body.

A drum 12, rotationally connected with the input shaft 6, comprises nine cylinders disposed parallel to the axis which are regularly distributed round this axis.

Each cylinder 14 contains a piston 16 of which the front end, indicated by arrow "AV", rests against an axial abutment 18 on a tilting tray 20 which is pivotable about an axis perpendicular to the input shaft 6, under the command of a hydraulic control cylinder 22 and a return spring 26.

The rear face of the drum 12 rests against a transverse circular plate 24 held by the cover 4, to close the rear opening of the cylinders 14. The plate 24 comprises a low pressure manifold and a high pressure manifold, each forming a circular arc covering a little less than half of the positions of cylinders 14.

Figure 2:
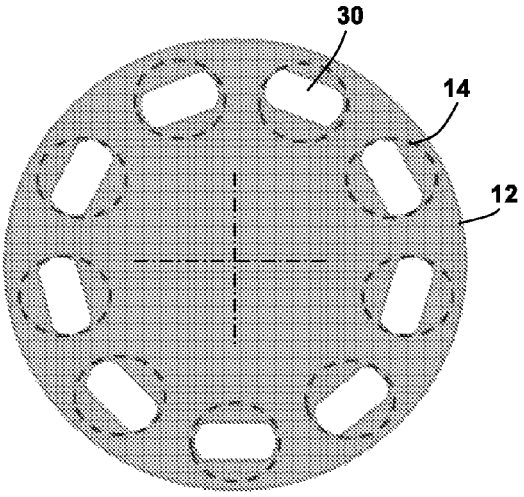
FIG. 2 is a rear view of the drum for this type of machine, comprising openings without angular offsets.

FIG. 2 represents the rear face of a drum 12 comprising nine cylinders 14 each shown by a dotted circle, which are disposed with an angular spacing regularly distributed around the main axis of the machine. Each cylinder 14 comprises an opening 30 which runs through this rear face of the drum 12, which is perfectly aligned to his cylinder.

In this way, when the drum 12 rotates, a constant period is obtained between each communication of a cylinder 14 with a manifold opening 30.

Figure 4:
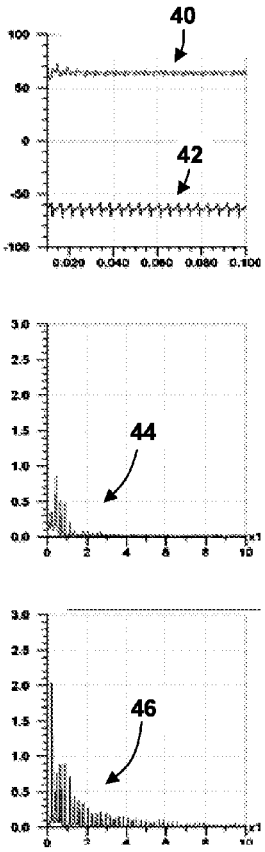
FIGS. 4 to 6 show in succession, for a machine without angular offset, openings with an angular offset calculated according to a first method, and with an angular offset calculated according to a second method, the top level of the excitation as a function of the times of the high pressure and low pressure circuits, and in the middle and bottom as a function of the frequency of the excitation level for the high pressure circuit and for the low pressure circuit, respectively.
Figure 5:
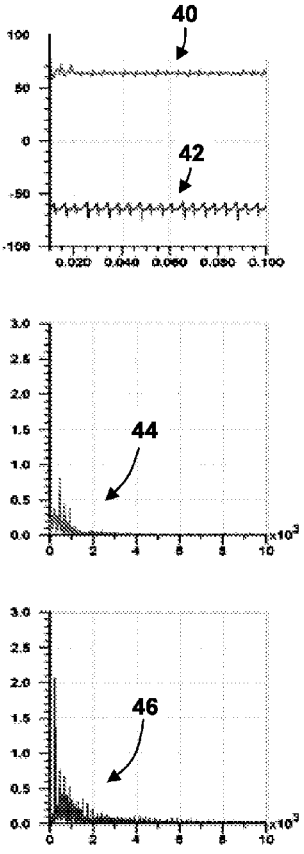
Figure 6:
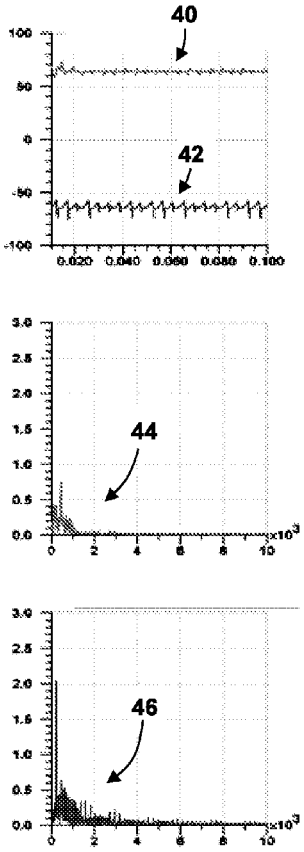

Each FIGS. 4 to 6 shows in the first graph as function of time, the pressure curves of the high pressure circuits 40 and low pressure circuits 42, comprising a periodic curve comprising a main oscillation frequency corresponding to the first frequency of the machine, as well as harmonics which superimpose themselves on this main frequency.

The second graph and third graph of these figures shows for, the high pressure circuit and the low pressure circuit, respectively, the level of excitation 44, 46 as function of the frequency.

FIG. 4 shows that, for each of the circuits, clearly distinctive excitation lines 44, 46 are obtained which are distributed over the whole width of the sound spectrum. The result is a pronounced siren noise, which is distinctly different from the sound emitted by an internal combustion engine.

Figure 3:
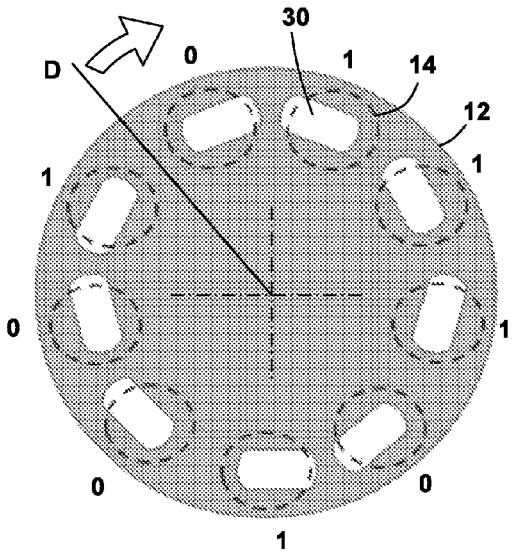
FIG. 3 is rear view of a drum for this type of machine, comprising openings with angular offsets according to the invention.

FIG. 3 represents the rear face of a drum 12 which comprises openings 30, which are all angularly offset relative to their cylinders 14, with an arrangement which is each time at one end of the total angular offset range. There are therefore two identical groups of openings 30, comprising an angular offset on either side of their cylinders 14.

The offset of each opening is noted by the number "1" when the offset is negative in the direction of rotation of the drum 12 indicated by the arrow, and "0" when the offset is positive. Starting from a start position D, the following sequence is obtained for the offset of the openings 30 of this hydraulic machine comprising nine cylinders:

1; 0; 0; 1; 0; 1; 1; 1; 0.

These angular offsets give irregular variations of the period between two successive communications of the cylinders 14 with the same manifold, which are not renewed inside this cycle.

The maximum offsets authorized in each direction for the pistons approaching the dead point or the low point, which do not involve any risk of cavitation due to excessive pressure drops, are taken to determine the total offset range. The total width of this range is then used to create the maximum angular offsets from one opening to another. It is to be noted that a wider offset range gives better results for the attenuation of the siren noise.

In practice, with an offset range between 2° and 4° the offset can advantageously be centered or offset on the axis of cylinder 14. For instance, for a total offset range of 2° the following offsets are obtained: −1°/+1° or −0.5°/+1.5° and for a total offset range of 4° the following offsets: −1°/+3° or −2°/+2°.

A particularly good result is obtained with a total offset range of 4° centered on the axis of the cylinder, which gives offsets of −2°/+2°.

In general, the same method can be applied on another machine comprising a different number of pistons.

In order to determine the offset sequences of the openings giving the best results with respect to the intensity and the signature of the noise emissions, a large number of combinations have been studied by the inventors. The sequence interference method called "Scrambler" has been identified as giving the best results to eliminate the siren noise with its harmonics, and to approach the noise signature emitted by an internal combustion engine.

The Scrambler method is used to eliminate the dependency of the acoustic power spectrum on the actual start signal, which emits the siren noise of the hydraulic machine, by making it more dispersed in order to obtain maximum spread of the acoustic energy of the frequency peaks over a larger frequency band. This method reduces the energy level of the emerging frequencies which cause the siren noise.

There are several Scrambler methods. A first method comprising an additive calculation method transforms the original data sequence in a pseudo random sequence, which applies a pseudo random binary order called "PRBS" (Pseudo Random Binary Sequence) by adding the modules in pairs. Another Scrambler method, comprising a multiplication calculation method, multiplies the input signal with a transfer function of the Scrambler, to give discrete linear systems.

FIG. 5 shows the analysis results for a hydraulic machine using the Scrambler method without pseudo random binary order "PRBS", comprising the multiplication method, and FIG. 6 shows the same results for a hydraulic machine using the Scrambler method with the pseudo random binary order "PRBS'" comprising the additive method.

It is to be noted that the second and third graph of FIG. 5 show a succession of frequency peaks forming combs, which are distinctly more detached than those shown in the same graphs of FIG. 6. The siren noise with the pseudo random binary order is more attenuated with the PRBS method comprising the additive calculation method, this method gives better results.

The PRBS method gives a binary sequence comprising a sequence of bits 0 or 1, which have a pseudo random character, and the value of each of the elements is independent of the other values. However this sequence is renewed with each rotation cycle of the machine, it is therefore of a periodic sequence, which makes it deterministic.

There are different types of calculations for the "PRBS" method, which give the following sequences for machines with between three and twenty pistons.

In particular for the above presented machine with nine pistons, the calculation type "PRBS $2^3$" comprising the sequence "1; 0; 0; 1; 0; 1; 1; 1; 0" has given good results. For the calculation type PRBS $2^3$, the following results are obtained:

3 pistons: 1 ;0 ;0
4 pistons: 1 ;0 ;0 ;1
5 pistons: 1 ;0 ;0 ;1 ;0
6 pistons: 1 ;0 ;0 ;1 ;0 ;1
7 pistons: 1 ;0 ;0 ;1 ;0 ;1 ;1
8 pistons: 1 ;0 ;0 ;1 ;0 ;1 ;1 ;1
9 pistons: 1 ;0 ;0 ;1 ;0 ;1 ;1 ;1 ;0
10 pistons: 1 ;0 ;0 ;1 ;0 ;1 ;1 ;1 ;0 ;0
11 pistons: 1 ;0 ;0 ;1 ;0 ;1 ;1 ;1 ;0 ;0 ;1
12 pistons: 1 ;0 ;0 ;1 ;0 ;1 ;1 ;1 ;0 ;0 ;1 ;0
13 pistons: 1 ;0 ;0 ;1 ;0 ;1 ;1 ;1 ;0 ;0 ;1 ;0 ;1
14 pistons: 1 ;0 ;0 ;1 ;0 ;1 ;1 ;1 ;0 ;0 ;1 ;0 ;1 ;1
15 pistons: 1 ;0 ;0 ;1 ;0 ;1 ;1 ;1 ;0 ;0 ;1 ;0 ;1 ;1 ;1
16 pistons: 1 ;0 ;0 ;1 ;0 ;1 ;1 ;1 ;0 ;0 ;1 ;0 ;1 ;1 ;1 ;0
17 pistons: 1 ;0 ;0 ;1 ;0 ;1 ;1 ;1 ;0 ;0 ;1 ;0 ;1 ;1 ;1 ;0 ;0
18 pistons: 1 ;0 ;0 ;1 ;0 ;1 ;1 ;1 ;0 ;0 ;1 ;0 ;1 ;1 ;1 ;0 ;0 ;1
19 pistons: 1 ;0 ;0 ;1 ;0 ;1 ;1 ;1 ;0 ;0 ;1 ;0 ;1 ;1 ;1 ;0 ;0 ; 1 ;0
20 pistons: 1 ;0 ;0 ;1 ;0 ;1 ;1 ;1 ;0 ;0 ;1 ;0 ;1 ;1 ;1 ;0 ;0 ; 1 ;0 ;1

For a calculation type "PRBS $2^4$" the following results are obtained:

3 pistons: 1 ;0 ;0
4 pistons: 1 ;0 ;0 ;0
5 pistons: 1 ;0 ;0 ;0 ;1
6 pistons: 1 ;0 ;0 ;0 ;1 ;0
7 pistons: 1 ;0 ;0 ;0 ;1 ;0 ;0
8 pistons: 1 ;0 ;0 ;0 ;1 ;0 ;0 ;1
9 pistons: 1 ;0 ;0 ;0 ;1 ;0 ;0 ;1 ;1
10 pistons: 1 ;0 ;0 ;0 ;1 ;0 ;0 ;1 ;1 ;0
11 pistons: 1 ;0 ;0 ;0 ;1 ;0 ;0 ;1 ;1 ;0 ;1
12 pistons: 1 ;0 ;0 ;0 ;1 ;0 ;0 ;1 ;1 ;0 ;1 ;0
13 pistons: 1 ;0 ;0 ;0 ;1 ;0 ;0 ;1 ;1 ;0 ;1 ;0 ;1
14 pistons: 1 ;0 ;0 ;0 ;1 ;0 ;0 ;1 ;1 ;0 ;1 ;0 ;1 ;1
15 pistons: 1 ;0 ;0 ;0 ;1 ;0 ;0 ;1 ;1 ;0 ;1 ;0 ;1 ;1 ;1
16 pistons: 1 ;0 ;0 ;0 ;1 ;0 ;0 ;1 ;1 ;0 ;1 ;0 ;1 ;1 ;1 ;1
17 pistons: 1 ;0 ;0 ;0 ;1 ;0 ;0 ;1 ;1 ;0 ;1 ;0 ;1 ;1 ;1 ;1 ;0
18 pistons: 1 ;0 ;0 ;0 ;1 ;0 ;0 ;1 ;1 ;0 ;1 ;0 ;1 ;1 ;1 ;1 ;0 ;0
19 pistons: 1 ;0 ;0 ;0 ;1 ;0 ;0 ;1 ;1 ;0 ;1 ;0 ;1 ;1 ;1 ;1 ; 0 ;0 ;0
20 pistons: 1 ;0 ;0 ;0 ;1 ;0 ;0 ;1 ;1 ;0 ;1 ;0 ;1 ;1 ;1 ;1 ; 0 ;0 ;0 ;1

For a calculation type "PRBS $2^5$" the following results are obtained:

3 pistons: 1 ;0 ;0
4 pistons: 1 ;0 ;0 ;0
5 pistons: 1 ;0 ;0 ;0 ;0
6 pistons: 1 ;0 ;0 ;0 ;0 ;1
7 pistons: 1 ;0 ;0 ;0 ;0 ;1 ;0
8 pistons: 1 ;0 ;0 ;0 ;0 ;1 ;0 ;0
9 pistons: 1 ;0 ;0 ;0 ;0 ;1 ;0 ;0 ;0
10 pistons: 1 ;0 ;0 ;0 ;0 ;1 ;0 ;0 ;0 ;1
11 pistons: 1 ;0 ;0 ;0 ;0 ;1 ;0 ;0 ;0 ;1 ;1
12 pistons: 1 ;0 ;0 ;0 ;0 ;1 ;0 ;0 ;0 ;1 ;1 ;0
13 pistons: 1 ;0 ;0 ;0 ;0 ;1 ;0 ;0 ;0 ;1 ;1 ;0 ;0
14 pistons: 1 ;0 ;0 ;0 ;0 ;1 ;0 ;0 ;0 ;1 ;1 ;0 ;0 ;1
15 pistons: 1 ;0 ;0 ;0 ;0 ;1 ;0 ;0 ;0 ;1 ;1 ;0 ;0 ;1 ;0
16 pistons: 1 ;0 ;0 ;0 ;0 ;1 ;0 ;0 ;0 ;1 ;1 ;0 ;0 ;1 ;0 ;1
17 pistons: 1 ;0 ;0 ;0 ;0 ;1 ;0 ;0 ;0 ;1 ;1 ;0 ;0 ;1 ;0 ;1 ;0
18 pistons: 1 ;0 ;0 ;0 ;0 ;1 ;0 ;0 ;0 ;1 ;1 ;0 ;0 ;1 ;0 ;1 ;0 ;1
19 pistons: 1 ;0 ;0 ;0 ;0 ;1 ;0 ;0 ;0 ;1 ;1 ;0 ;0 ;1 ;0 ;1 ; 0 ;1 ;1
20 pistons: 1 ;0 ;0 ;0 ;0 ;1 ;0 ;0 ;0 ;1 ;1 ;0 ;0 ;1 ;0 ;1 ; 0 ;1 ;1 ;1

In this way a solution is obtained which does not add supplementary cost to the machine, and which reduces the noise level while giving these emissions a definitively more pleasant signature which does not bother the driver while functioning in hybrid mode, giving successive transitions from one traction mode to the other in a transparent manner for the driver and the passengers.

The invention claimed is:

1. A hydraulic machine comprising a drum rotationally driven by an input shaft, comprising cylinders distributed around the axis, each cylinder receiving a piston which moves in said cylinder as a function of the shaft rotation, each cylinder communicating with an associated opening on a transverse face of the drum and resting against a circular plate having input and output manifolds, wherein the openings each comprise a leading end and a trailing end; each said opening being positioned relative to its cylinder such that each opening is angularly offset from its cylinder within a total offset range such that one of the leading edge and trailing edge of each opening extends beyond an edge of the opening's associated cylinder to define either a trailing offset or a leading offset, wherein the offsets of these openings are disposed on both ends of this offset range such that the sum of the trailing offset and leading offset equals the offset range, and wherein the noise signature of the hydraulic machine approaches the noise signature of an internal combustion engine.

2. The hydraulic machine according to claim 1, wherein the total range of offsets of the openings is between 2° and 4°.

3. The hydraulic machine according to claim 1, wherein the offset range for each cylinder is centered on the axis of the corresponding cylinder.

4. The hydraulic machine according to claim 1, wherein the hydraulic machine comprises nine pistons comprising opening offsets on both sides of the offset range, which follow the following sequence for an offset noted "0" on one side and "1" on the other side: 1; 0; 0; 1; 0; 1; 1; 1; 0.

5. The hydraulic machine according to claim 1, wherein the offset sequence of the openings is determined by according to a calculation method using a "Scrambler" type sequence interference method.

6. The hydraulic machine according to claim 5, wherein said calculation method comprises an additive calculation method, transforming the original data sequence in a sequence which applies a pseudo random binary order of the type "BRPS", by adding the modules in pairs.

7. A hybrid automotive vehicle having at least one hydraulic machine used for traction, characterized in that this machine is constructed according to claim 1.

8. The hydraulic machine according to claim 1 wherein the angular offset of each opening relative to its associated cylinder is the same.

9. A method of forming a drum of a hydraulic machine such that a noise signature of the hydraulic machine approaches the noise signature of an internal combustion engine, wherein the cylinder drum is to be rotationally driven by an input shaft and comprises cylinders distributed around an axis of the drum; each cylinder receiving a piston which moves in said cylinder as a function of rotation of the shaft, each cylinder communicating with an associated opening on a transverse face of the drum and resting against a circular plate having input and output manifolds; the openings each comprise a leading end and a trailing end; each said opening being positioned relative to its associated cylinder such that each opening is angularly offset from its associated cylinder within a total offset range such that one of the leading edge and trailing edge of each opening extends beyond an edge of the opening's associated cylinder to define either a trailing offset or a leading offset, wherein the offsets of these openings are disposed on both ends of this offset range such that the sum of the trailing offset and leading offset equals the offset range;

the method comprising determining the sequence of offsets according to a calculation method using a "Scrambler" type sequence interference method.

10. The method of claim 9 wherein said calculation method comprises an additive calculation method, transforming the original data sequence in a sequence which applies a pseudo random binary order of the type "BRPS", by adding modules in pairs.

* * * * *